United States Patent [19]

Brown

[11] Patent Number: 4,738,547

[45] Date of Patent: Apr. 19, 1988

[54] CARRYING BAG

[76] Inventor: Gardner R. Brown, 1101 S. Arlington Ridge Rd. #1112, Arlington, Va. 22202

[21] Appl. No.: 383,153

[22] Filed: May 28, 1982

[51] Int. Cl.[4] ..... A45C 11/00; A45C 11/36; A45C 13/00; A45C 13/36

[52] U.S. Cl. ..... 383/39; 383/40; 383/119

[58] Field of Search ..... 150/1; 383/4, 127, 39, 383/38, 40, 119

[56] References Cited

U.S. PATENT DOCUMENTS

| | | | |
|---|---|---|---|
| 503,355 | 8/1893 | Phillips | 150/1 X |
| 1,291,914 | 1/1919 | Kelley | 150/1 X |
| 1,495,220 | 5/1924 | Carroll | 150/1 |
| 2,441,415 | 5/1948 | Hoishman | 150/1 X |
| 3,029,852 | 4/1962 | Taylor | 150/1 |
| 3,134,416 | 5/1964 | Magyar | 150/1 X |
| 3,143,748 | 8/1964 | Manning | 150/1 X |
| 3,181,751 | 5/1965 | Wilson | 150/1 X |
| 3,489,194 | 1/1970 | Hoover | 150/1 |
| 3,967,666 | 7/1976 | Farrar | 150/1 |
| 4,164,968 | 8/1979 | Esposito, Jr. et al. | 150/1 |

FOREIGN PATENT DOCUMENTS

| | | | |
|---|---|---|---|
| 1249975 | 10/1971 | United Kingdom | 150/1 |

*Primary Examiner*—William Price
*Assistant Examiner*—Sue A. Weaver
*Attorney, Agent, or Firm*—Boris Haskell

[57] ABSTRACT

A carrying bag formed of a plurality of panels adapted to be folded over each other and to be thus fastened together to facilitate carrying of the bag and its contents. When the panels are unfolded, the bag is adapted to be hung on a vertical wall. The panels carry a plurality of pockets specifically designed for housing selected instruments or implements. Stays are provided as stiffeners in the direction of the fold lines.

5 Claims, 3 Drawing Sheets

CARRYING BAG

SUMMARY OF INVENTION

The present invention relates generally to carrying bags. It relates to a foldable panel bag that in folded condition is intended to function as a convenient tote container, and in its open or unfolded condition is intended to be hung on a wall or other vertical surface to render the contents readily accessible. The carrying bag of the present invention is further intended as a special purpose bag, although not necessarily limited thereto; and as one illustrative example, that special purpose may be for navigational equipment and implements. In the ensuing description of the invention, it is described at times with particular reference to navigator's use, but obviously this is for illustrative purposes only, and it is not intended that the invention be limited thereto. For example, the bag might be designed for photographer use, draftsman use, etc.

As stated, the bag is intended to be folded for tote purposes, and to be opened by unfolding and to be hung on a vertical wall to render the contents accessible. The folding is accomplished by providing a plurality of panels in side by side hinged relation, adapted to be folded over each other. The bag panels are formed of a relatively flexible or pliant material, such as canvas, leather, heavy guage vinyl type plastic, or the like. There are also provided a plurality of elongate stiffeners or stays set into the panels parallel to the fold lines, so that the bag has rigidity in that direction. To facilitate carrying the bag, the adjacent ends of the two panels that become the outer panels when the bag is folded are provided with handle straps. When the bag is unfolded, it is intended that the bag may be hung on a vertical wall, and to that end grommets are mounted in the bag panels at appropriate points along the top edge, and and along the bottom if desired, to facilitate hanging the bag on appropriate hooks, or the like. When the bag is open and hung in this fashion, it presents a plurality of readily accessible pockets, all opening upwardly, toward the carrying handles. It is intended that the pockets be designed in size and depth to contain specific instruments or devices, according to the special use for which the bag is intended. When the bag is folded into tote condition, the instruments and devices are securely contained within their pockets which face inwardly of the bag, and the combination of heavy panel material and vertical stiffeners or stays affords good protection for the contents.

It is therefore one object of the present invention to provide a carrying bag, formed of a plurality panels foldable over each other.

Another object of the present invention is to provide a carrying bag, formed of a plurality of panels foldable over each other, which when unfolded, are adapted to be hung on a vertical or like surface to render the contents readily accessible.

Still another object of the present invention is to provide such a foldable and unfoldable carrying bag, wherein appropriate pockets are provided on the several panels designed to house the instruments and implements of some special purpose for which the bag is intended.

Other objects and advantages of the invention will become apparent from a consideration of a detailed description of one illustrative embodiment of the invention presented herein below. That description is had in conjunction with the accompanying drawings, wherein like reference characters refer to like or corresponding parts.

DETAILED DESCRIPTION

Figure 1:
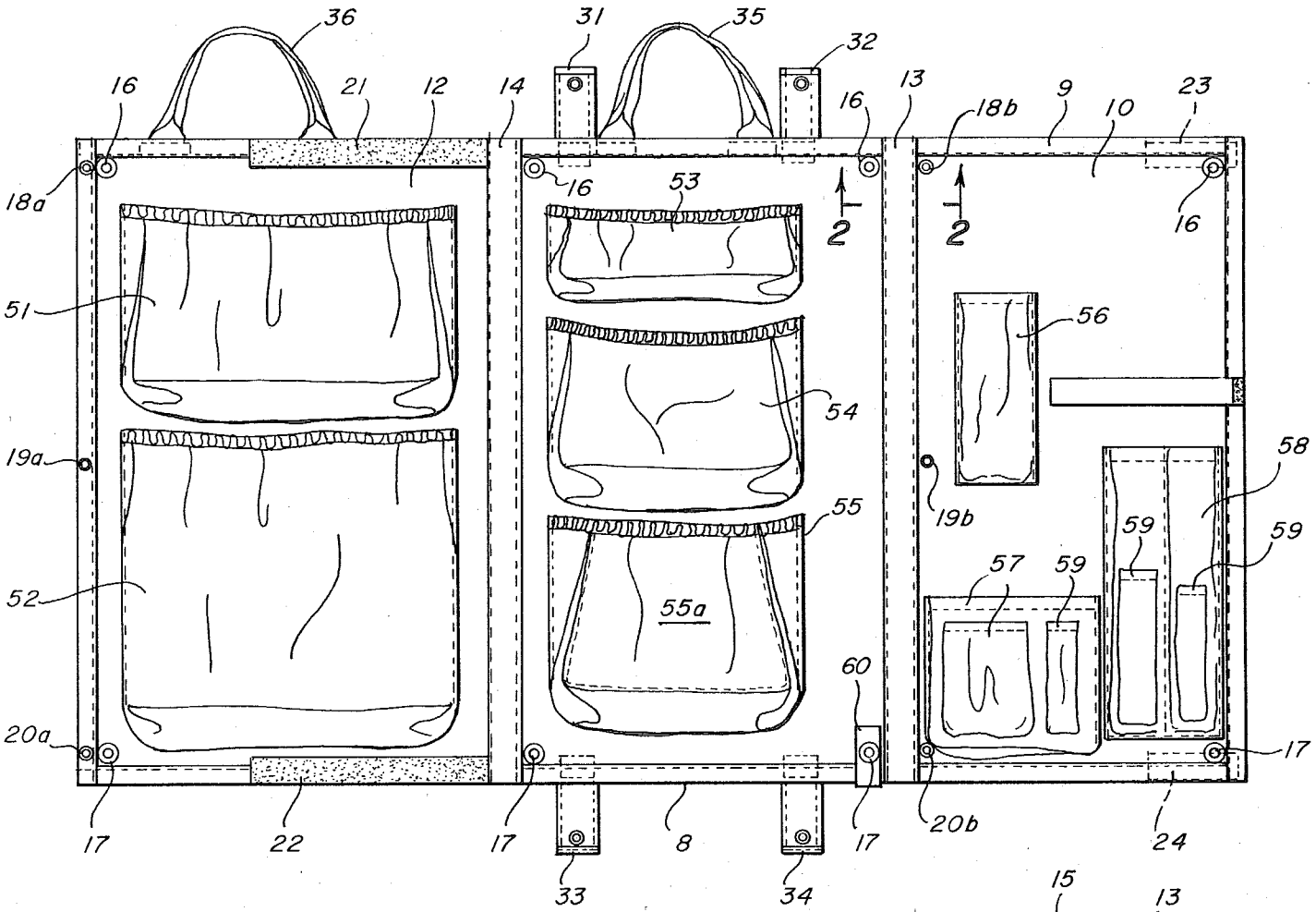
FIG. 1 is a vertical plan view of a three panel carrying bag embodying the present invention, shown in open or unfolded condition as it would appear if hung on a vertical wall.
Figure 2:
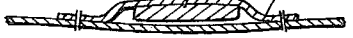
FIG. 2 is a fragmentary and enlarged cross-sectional view taken along the line 2—2 in FIG. 1.

Referring to FIG. 1, the carrying bag is shown as comprising three panels 10, 11 and 12, all formed by a single web but defined into panels by the elongate separating pockets 13 and 14, each pocket housing an elongate stiffener or stay 15. Four metal grommets 16 are set in across the top edge 9 of the open bag, and a corresponding set of four grommets 17 are set in across the bottom edge 8. These grommets provide reinforced holes or openings to permit the open bag to be hung on a vertical wall or the like by means such as hooks. The top set of grommets 16 would be sufficient for hanging the bag; but since in its preferred embodiment the bag is intended for use by navigators on board relatively small boats, such as racing yachts, the lower set of grommets 17 are used to stabilize the hanging bag against the pitch and roll of the boat.

Three pairs of mating snap fasteners are provided along the outside edge of panel 12 and the inside edge of panel 10. These paired snap fasteners are designated as 18*a* and *b*, 19*a* and *b*, and 20*a* and *b*. Strips of Velcro fastening 21 and 22 are affixed along the upper and lower edges of panel 12, and cooperating Velcro patches 23 and 24 are affixed to the back side of the upper and lower edges of panel 10.

Figure 5:
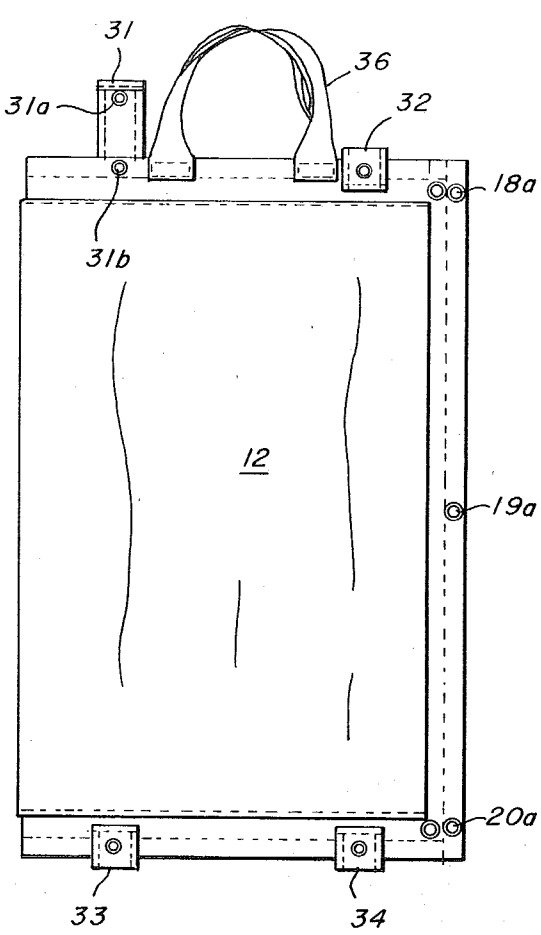
FIG. 5 is a view of the bag shown in FIG. 4 with the other end panel also folded over to the center, the bag being shown in closed or tote condition.
Figure 4:
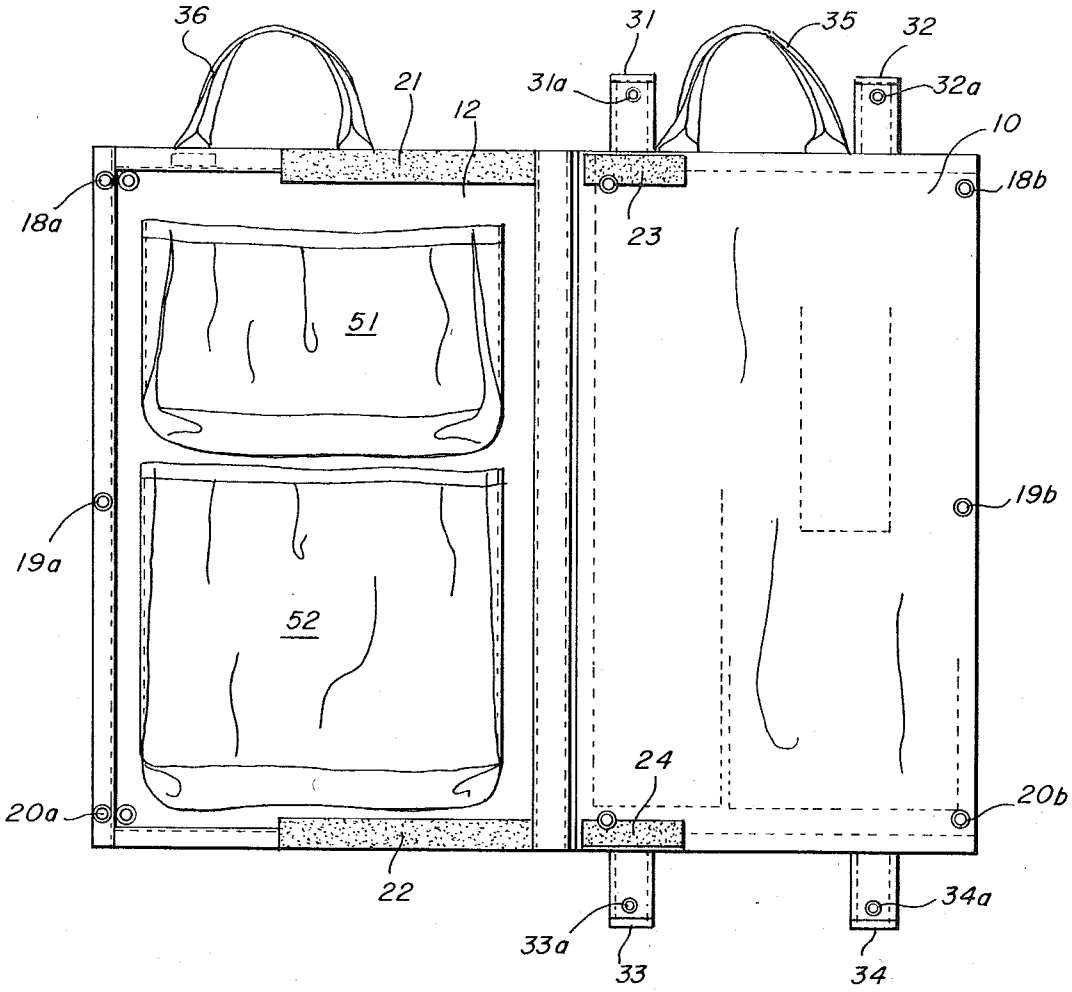
FIG. 4 is a view of the bag shown in FIG. 1 with one end panel folded over the center panel.

When folding the bag from the open position of FIG. 1, first the panel 10 is superposed over panel 11 as shown in FIG. 4., then the panel 12 is superposed over panel 10, as shown in FIG. 5. In the latter operation, the Velcro strips 21 and 22 and cooperating Velcro patches 23 and 24 are brought into engaging and fastening relation. Also the snap fastener portions 18*a*, 19*a* and 20*a* engage with the respective mating portions 18*b*, 19*b* and 20*b*. There are also provided a pair of top tabs 31 and 32 and a pair of bottom tabs 33 and 34 affixed to panel 11. Each of these tabs carries a snap fastener portion 31*a*, 32*a*, 33*a* and 34*a*. When the bag is fully folded as shown in FIG. 5, the back side of panel 12 presents four mating snap fastener portions 31*b*, 32*b*, 33*b* and 34*b*. The tabs 31, 32, 33 and 34 are turned down to engage those respective mating snap fastener portions. The bag is now fully closed and secured, for being carried by means of the handles 35 and 36.

Although the bag is formed of a flexible or pliant material, the fastening structures and arrangement provide a secure tote bag, so that none of the panels can shift relative to each other. And the vertical stays 15 provide a rigidity to the bag so it will not crumple or fold in the vertical direction.

For purposes of illustration, a specific set of upwardly opening pockets are shown, which are designed to house the implements and instruments of a racing yacht navigator. They are: nautical almanac at 51, sextant at 52, flashlight at 53, spare batteries, erasers, etc. at 54, binoculars at 55, hand compass at 55*a*, chart reading light at 56, calculator and accessories at 57, parallel rules and protractor at 58, and compass, dividers, pencils etc. at 59.

Obviously, a reinforcing seam or binding may be provided around the perimeter of the open bag, and other reinforcements may be provided as desired or appropriate, as is for example shown at 60 to reinforce the grommet setting.

Figure 3:
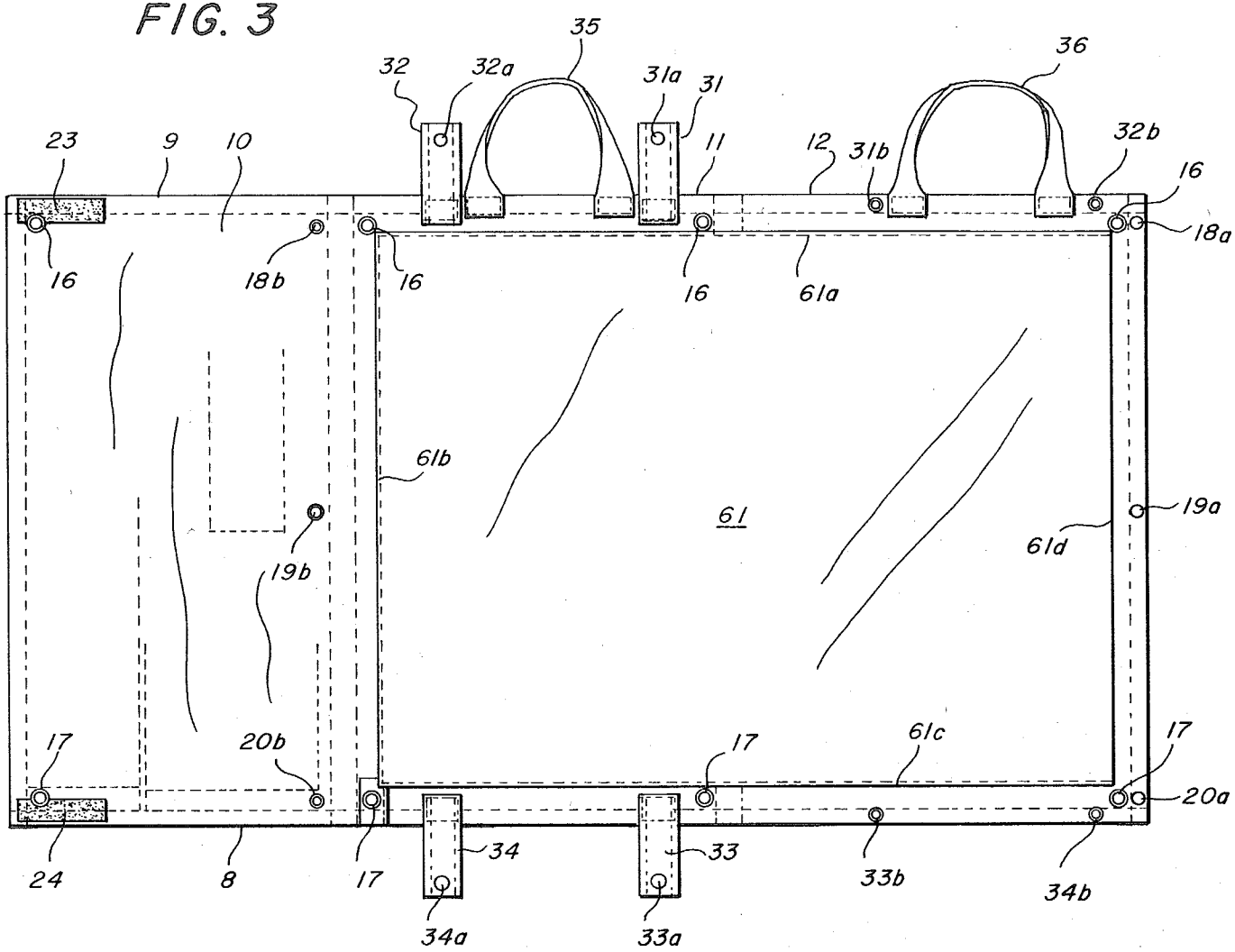
FIG. 3 is a view of the back side of the bag shown in FIG. 1.

When designed as a navigator bag, it is desirable to provide a pocket for charts. This is done on the back side as shown in FIG. 3. There, a supplemental web 61 is sewn along three sides 61*a*, 61*b* and 61*c* over the back side of the area defined by panels 11 and 12. The end 61*d* is left unattached, thereby providing a large pocket for the insertion of navigation charts. Instead of being sewn on all three sides, two sides of this chart pocket could be provided with separable fastenings, such as Velcro, zipper, or the like, to facilitate easy insertion of charts into the pocket.

The foregoing specific embodiment is presented only to illustrate, and to facilitate an understanding of the invention. Many modifications and variations will be apparent to those skilled in the art; and those that are embraced by the spirit and scope of the appended claims are contemplated as being within the purview of the invention.

What is claimed is:

1. A carrying bag having a top and bottom and having three side by side panels of substantially the same dimensions formed of flexible material and hinged together along their sides to be folded over each other in substantially congruent overlying relation, one panel being a central panel and each of the other two panels being hinged to a respective one of the two sides of the central panel as side panels, a first of said panels on a first side of said central panel being foldable along a first hinge area to a position overlying said central panel, and a second of said side panels on the second side of said central panel being foldable along a second hinge area to a position overlying said first side panel when said first side panel is folded over said central panel, the facing surfaces of said two side panels when folded with said first side panel overlying said central panel and said second side panel overlying said first side panel having two sets of cooperating separable fastening means along their edges to prevent relative movement therebetween when fastened together, one set of said separable fastening means being adjacent said first hinge area with cooperating fastening elements on facing surfaces of said first and second side panels, and a second set of said separable fastening means being adjacent said second hinge area with cooperating fastening elements on facing surfaces of said first and second side panels, elongate stays mounted along the hinge areas of said panels extending substantially from the top to the bottom of the carrying bag to prevent folding of the bag transversely of said stays, means on said panels for mounting said bag on a vertical wall when said panels are unfolded, and pocket means carried by each of said three panels for retaining implements or instruments therein.

2. A carrying bag as set forth in claim 1 and including additional separable fastening means for fastening said central panel to said second side panel when said side panels are folded with said first side panel overlying said central panel and said second side panel overlying said first side panel.

3. A carrying bag as set forth in claim 2, wherein said additional separable fastening means comprises a strap permanently affixed at one end to one of said central and second side panels and separably fastenable at the other end to the other of said central and second side panels.

4. A carrying bag as set forth in claim 1, 2 or 3, and further including a carrying handle means.

5. A carrying bag as set forth in claim 4, wherein said carrying handle means comprises a first handle on said central panel and second handle on said second side panel.

* * * * *